US005351857A

United States Patent [19]

Gonzalez

[11] Patent Number: 5,351,857

[45] Date of Patent: Oct. 4, 1994

[54] WRITING INSTRUMENT DISPENSER APPARATUS

[76] Inventor: Luis R. Gonzalez, 6708 Willow Spring Ct., Tampa, Fla. 33615

[21] Appl. No.: 88,389

[22] Filed: Jul. 9, 1993

[51] Int. Cl.[5] ..... G07F 11/24

[52] U.S. Cl. ..... 221/265; 221/277; 221/285; 248/205.4; 248/206.5

[58] Field of Search ..... 221/265, 277, 282, 283, 221/284, 285, 294; 248/346, 500, 205.3, 205.4, 206.5

[56] References Cited

U.S. PATENT DOCUMENTS

| | | | |
|---|---|---|---|
| 1,072,758 | 9/1913 | Miller | 221/265 X |
| 1,182,793 | 5/1916 | Richardson | 221/277 X |
| 1,269,768 | 6/1918 | Whitener | 221/277 X |
| 2,479,860 | 8/1949 | Otis | 221/277 X |
| 2,684,179 | 7/1954 | Sachs | 221/277 X |
| 3,294,285 | 12/1966 | Kovacevic | 221/277 X |
| 4,025,015 | 5/1977 | Kolic | 248/205.3 |
| 4,067,532 | 10/1978 | Viteretto | 248/205.3 X |
| 4,852,767 | 8/1989 | Humphrey | 221/277 X |
| 4,999,887 | 3/1991 | Kraus | 248/205.3 X |

*Primary Examiner*—Robert P. Olszewski
*Assistant Examiner*—Dean A. Reichard
*Attorney, Agent, or Firm*—E. Michael Combs

[57] ABSTRACT

A housing arranged to dispense individual pen or pencil members is provided to include a housing having a front wall, with the front wall including an entrance opening and first and second ramp members arranged in a V-shaped configuration extending from the front wall opening terminating below a hopper mounting a plurality of the writing instruments. A rotary dispensing shaft having an elongate slot to receive individual writing instruments therewithin is rotatably mounted, including arcuate flanges to prevent additional writing instruments from access to the dispensing shaft and to the ramp structure, whereupon rotation of the dispensing shaft deposits a writing instrument upon the second ramp and the first ramp for access by an individual through the front wall opening.

4 Claims, 5 Drawing Sheets

WRITING INSTRUMENT DISPENSER APPARATUS

BACKGROUND OF THE INVENTION

1. Field of the Invention

The field of invention relates to dispenser apparatus, and more particularly pertains to a new and improved writing instrument dispenser apparatus wherein the same is arranged to dispense on an individual basis elongate writing instruments through a rotary motion of a dispenser shaft.

2. Description of the Prior Art

Dispensing apparatus of various types have been utilized throughout the prior art and exemplified by U.S. Pat. Nos. 5,044,520; 5,009,930; and 5,067,630.

The instant invention attempts to overcome deficiencies of the prior art by providing for a dispensing apparatus arranged for the dispensing of pencil or pen members and in this respect, the present invention substantially fulfills this need.

SUMMARY OF THE INVENTION

In view of the foregoing disadvantages inherent in the known types of dispenser apparatus now present in the prior art, the present invention provides a writing instrument dispenser apparatus wherein the same employs a rotary dispensing shaft arranged to receive a pencil for dispensing through a front wall opening. As such, the general purpose of the present invention, which will be described subsequently in greater detail, is to provide a new and improved writing instrument dispenser apparatus which has all the advantages of the prior art dispenser apparatus and none of the disadvantages.

To attain this, the present invention provides a housing arranged to dispense individual pen or pencil members, to include a housing having a front wall, with the front wall including an entrance opening and first and second ramp members arranged in a V-shaped configuration extending from the front wall opening terminating below a hopper mounting a plurality of the writing instruments, A rotary dispensing shaft having an elongate slot to receive individual writing instruments therewithin is rotatably mounted, including arcuate flanges to prevent additional writing instruments from access to the dispensing shaft and to the ramp structure, whereupon rotation of the dispensing shaft deposits a writing instrument upon the second ramp and the first ramp for access by an individual through the front wall opening.

My invention resides not in any one of these features per se, but rather in the particular combination of all of them herein disclosed and claimed and it is distinguished from prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved writing instrument dispenser apparatus which has all the advantages of the prior art dispenser apparatus and none of the disadvantages.

It is another object of the present invention to provide a new and improved writing instrument dispenser apparatus which may be easily and efficiently manufactured and marketed.

It is a further object of the present invention to provide a new and improved writing instrument dispenser apparatus which is of a durable and reliable construction.

An even further object of the present invention is to provide a new and improved writing instrument dispenser apparatus which is susceptible of a low cost of manufacture with regard to both materials and labor, and which accordingly is then susceptible of low prices of sale to the consuming public, thereby making such writing instrument dispenser apparatus economically available to the buying public.

Still yet another object of the present invention is to provide a new and improved writing instrument dispenser apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
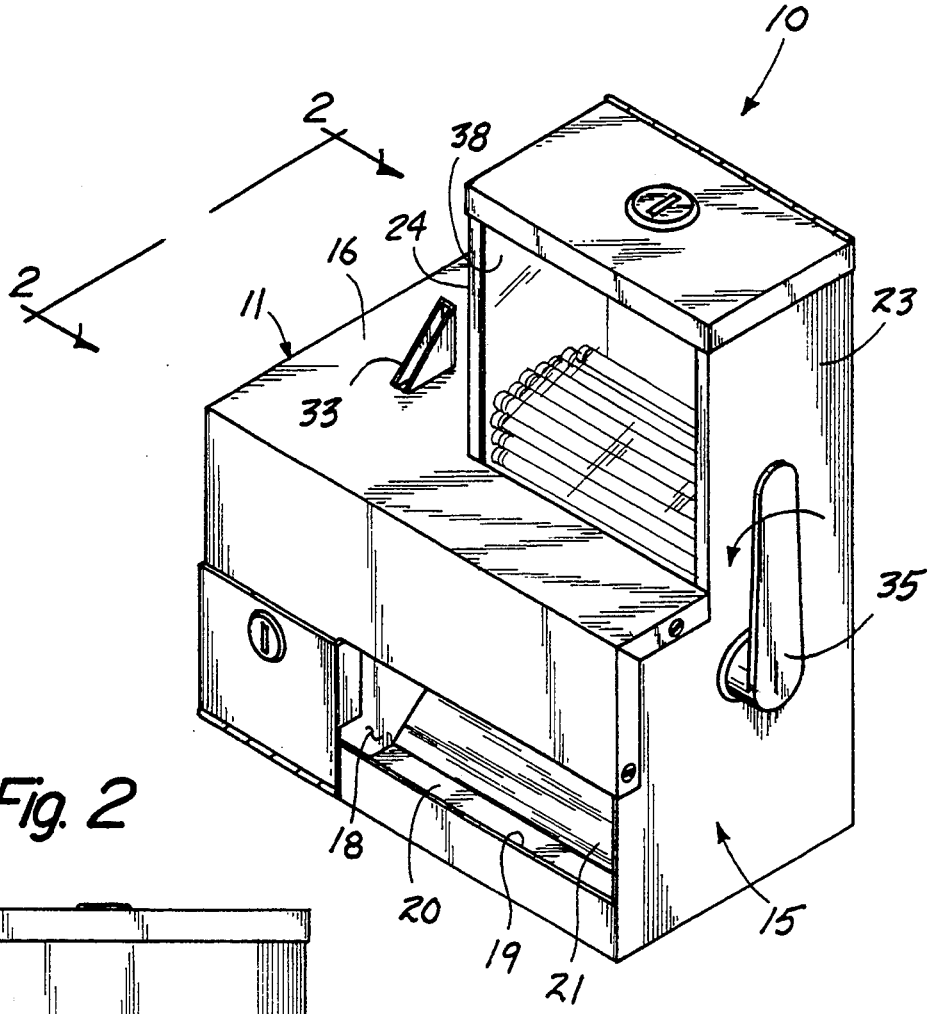
FIG. 1 is an isometric illustration of the invention.
Figure 2:
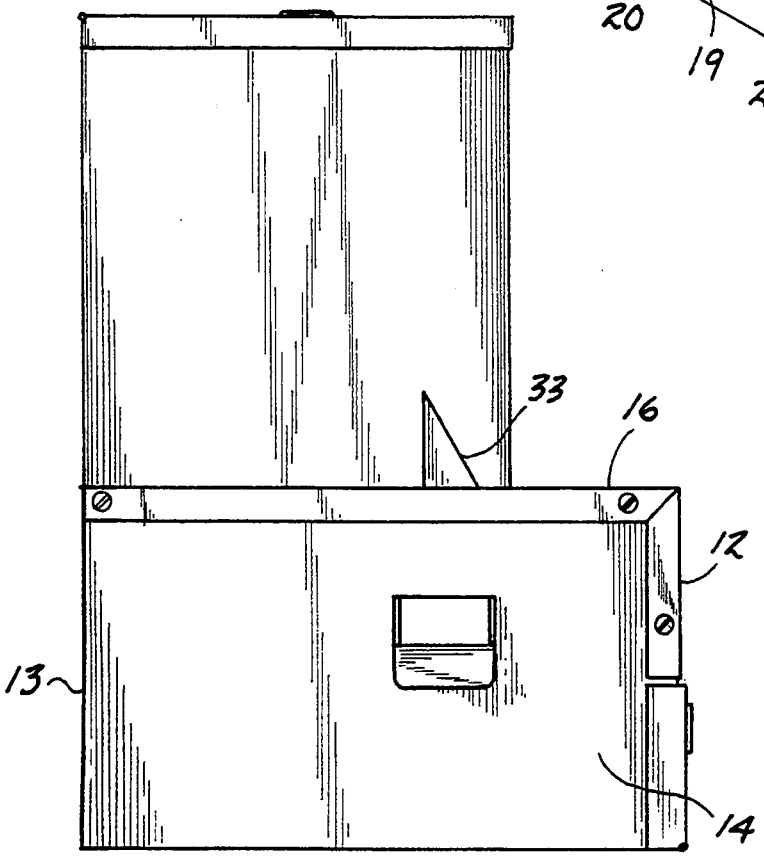
FIG. 2 is an orthographic view, taken along the lines 2—2 of FIG. 1 in the direction indicated by the arrows.
Figure 3:
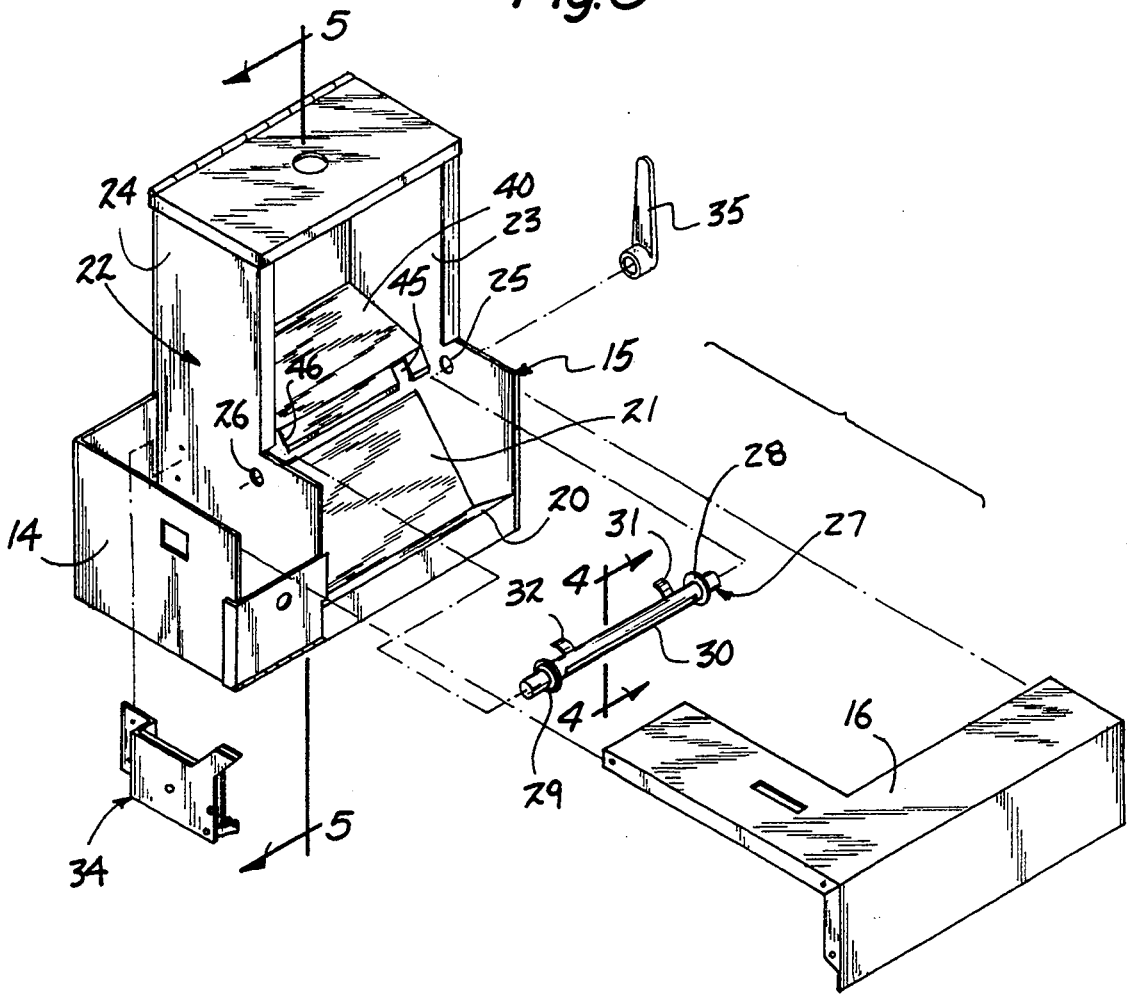
FIG. 3 is an isometric view, somewhat exploded, of the dispenser apparatus of the invention.
Figure 4:
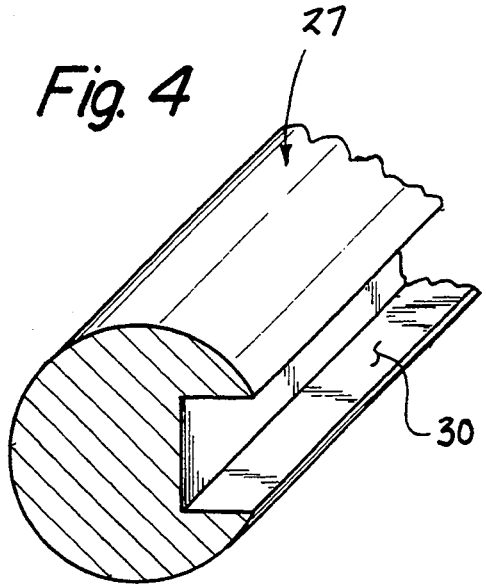
FIG. 4 is an isometric illustration, taken along the lines 4—4 of FIG. 3 in the direction indicated by the arrows.

With reference now to the drawings, and in particular to FIGS. 1 to 9 thereof, a new and improved writing instrument dispenser apparatus embodying the principles and concepts of the present invention and generally designated by the reference numeral 10 will be described.

Figure 5:
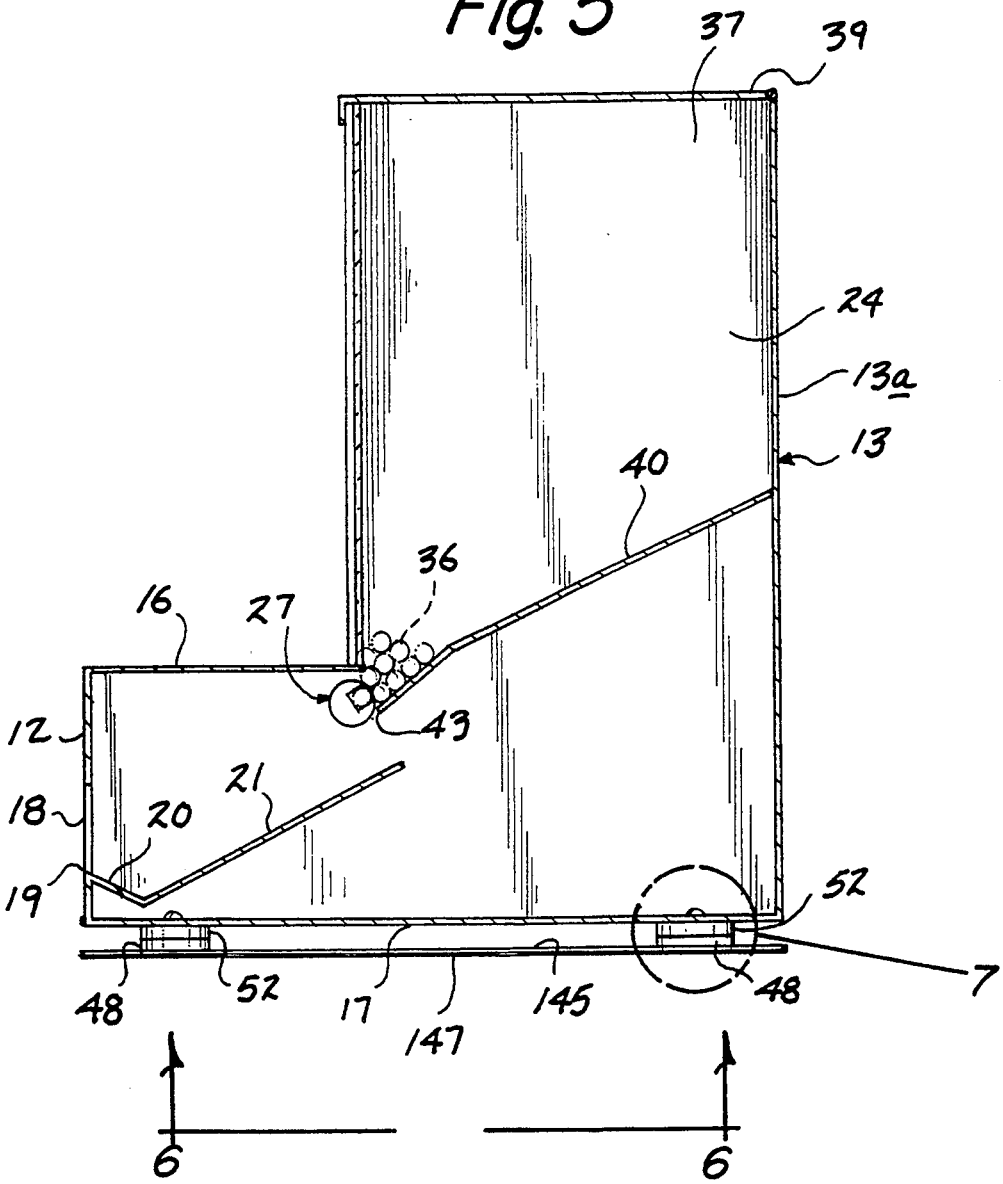
FIG. 5 is an orthographic view, taken along the lines 5—5 of FIG. 3 in the direction indicated by the arrows.
Figure 6:
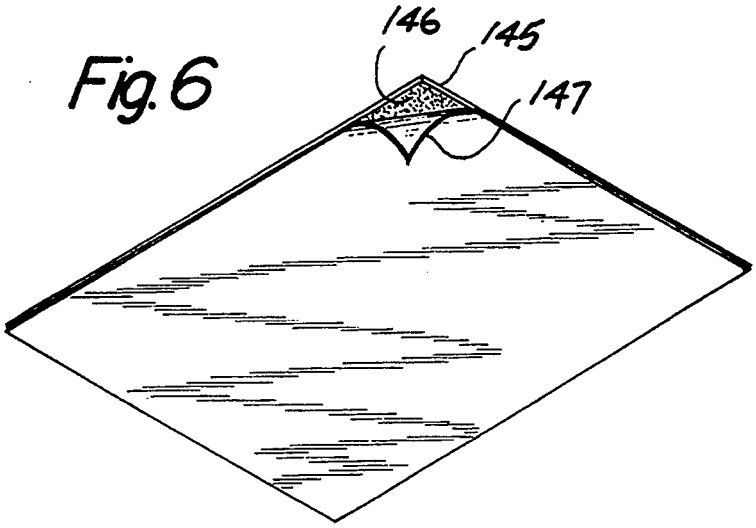
FIG. 6 is an isometric illustration, taken along the lines 6—6 of FIG. 5 in the direction indicated by the arrows.
Figure 7:
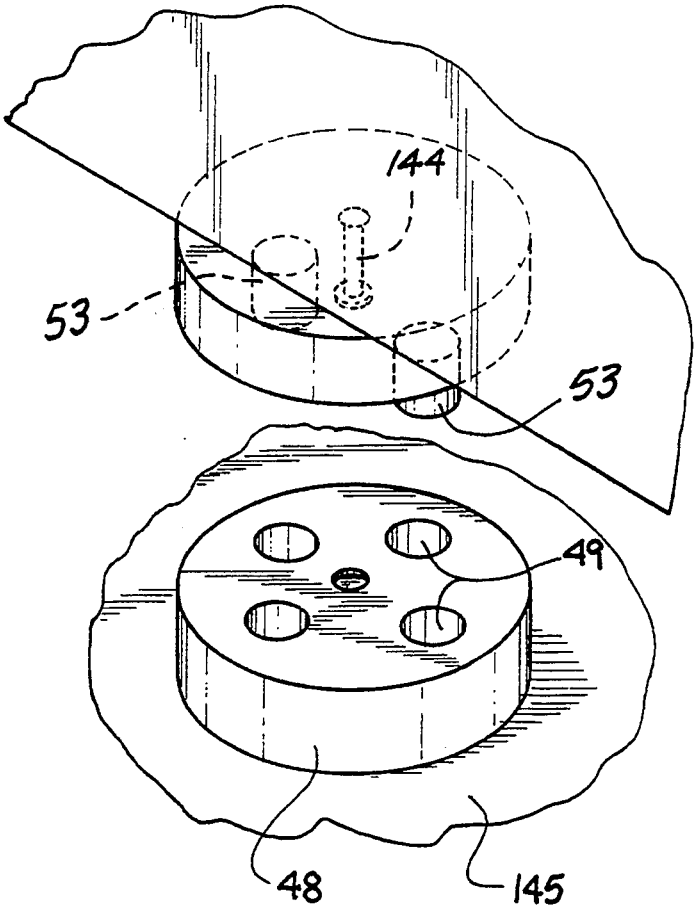
FIG. 7 is an enlarged isometric illustration of section 7 in exploded view as indicated in FIG. 5.
Figure 8:
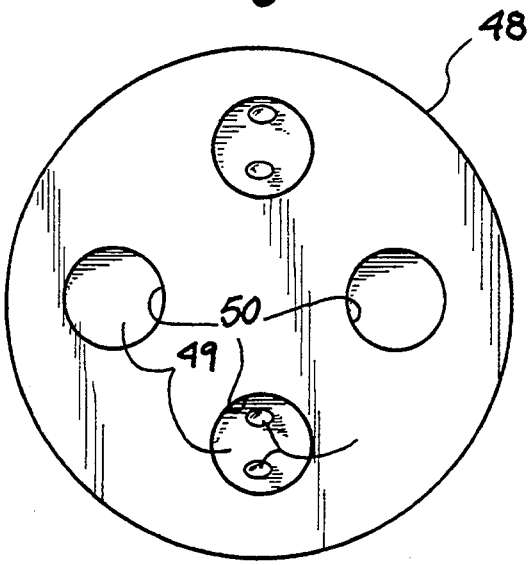
FIG. 8 is an orthographic top view of the port boss member structure, as indicated in FIG. 7.
Figure 9:
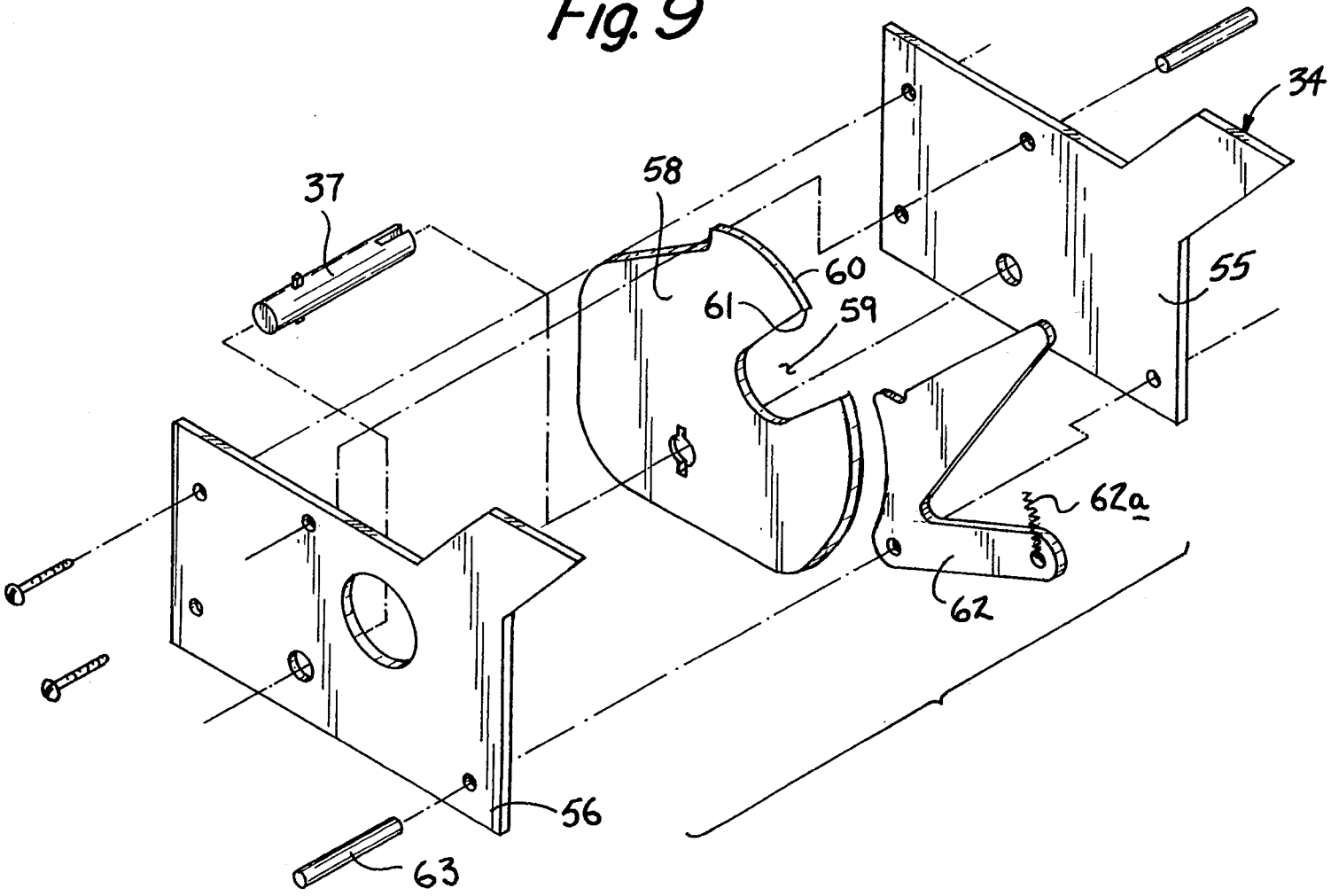
FIG. 9 is an isometric exploded view of an exemplary release mechanism for use by the invention.

More specifically, the writing instrument dispenser apparatus 10 of the instant invention essentially comprises a base housing 11 having a housing front wall 12 spaced from a housing rear wall 13. A housing first side wall 14 is spaced from and parallel to a housing second side wall 15 that is of a predetermined L-shaped configuration extending above a housing top wall 16, that in turn is spaced from a housing floor 17. The housing front wall includes a front wall opening 18, having a lowermost edge 19 that has extending therefrom in a coextensive relationship a first ramp 20 directed into the housing 11 directed from the lowermost edge 19 towards the floor 17, with a second ramp 21 extending from the first ramp 20, with the first ramp having a first length, with the second ramp having a second length, the second length greater than the first length and the second ramp 21 extending in an orthogonal relationship between the second side wall 15 and an associated intermediate wall 22 that is also of said predetermined L-shaped configuration in turn extending above the top wall 16. The second side wall 15 and the intermediate wall 22 include respective second side wall and intermediate wall extension flanges 23 and 24 respectively. A first opening 25 coaxially aligned with the second opening 26 are directed through the second side wall 15 and the intermediate wall 22 in adjacency to the associated extension flanges 23 and 24 respectively, with a dispensing shaft 27 having a shaft first end received through the first opening 25 and a shaft second end received through the second opening 26. A first flange 28 mounted to the dispensing shaft is arranged for sliding engagement with an interior surface of the second side wall 15, with the first flange 28 oriented between the second side wall and the intermediate wall, with the second flange spaced from and parallel to the first flange positioned between the intermediate wall and the first flange for sliding engagement of the first and second flanges relative to the second side wall and intermediate wall respectively. The shaft includes a shaft slot 30 extending between the first and second flanges 28 and 29 to receive a writing instrument such as a pen or pencil member 36, in a manner as indicated in FIG. 5. It should be further noted that first and second arcuate flanges 31 and 32 that are arranged in parallel coextensive relationship relative to one another extend in a radial orientation relative to the dispensing shaft 27 and are angularly displaced relative to the shaft slot 30, in a manner to be described in more detail below. A coin slot 33 directed through the top wall is in operative communication with a release mechanism 34 that receives a second end of the shaft 27, wherein a first end of the shaft 27 mounts a handle 35 exteriorly of the housing, in a manner as indicated in FIG. 1 for example. The type of release mechanism desired, such as a mechanism 34, is subject to commercial availability to one of ordinary skill in the art, and whose criticality is of secondary significance to the invention described here within. FIG. 9 indicates a release mechanism contemplated for potential use having inner and outer plates 55 and 56, wherein the release mechanism 34 includes a connecting shaft 37 rotatably directed through the inner and outer plates 55 and 56, as well as through a turning plate 58, with the connecting shaft 37 fixedly mounted to the turning plate 58 and the connecting shaft 37 fixedly mounted and coaxially aligned with the shaft 27. The turning plate 58 includes a turning plate slot 59 directed into the turning plate 58 from the turning plate outer periphery 60. A turning plate abutment 61 is defined at an intersection of the outer periphery 60, with the slot 59 at an entrance to the slot 59. The use of a stop lever 62 having a stop lever spring 62*a* is mounted and secured to the inner plate 55 to bias tile stop lever 62 to engage the outer periphery 60. The stop lever is pivotally mounted about a stop lever axle 63 orthogonally directed through the inner and outer plates 55 and 56 as indicated, wherein a stop lever projecting lug is arranged to abut the turning plate abutment 61 in the absence of a coin or in the presence of an undersized coin. Upon positioning of the properly sized coin within the turning plate slot 59, the stop lever projecting lug rides over such coin and over and beyond the turning plate slot 59 in use permitting rotation of the shaft 27 by the handle 35.

A hopper 37 is oriented between the second side wall and intermediate wall extension flanges 23 and 24, with the hopper having a front wall 38 and a hopper rear wall 13*a* formed as an extension flange of the rear wall 13. The hopper includes a hopper lid 39 that is positioned over the hopper, with a hopper floor 40 canted from the rear wall extension flange to an orientation below the hopper front wall 38 and spaced above the second ramp 21 relative to the hopper forward edge 43. In this manner, the pencil members 36 are rotatably directed towards the dispensing shaft 27. The hopper floor includes respective floor first and second slots 45 and 46 arranged to receive the respective first and second arcuate flanges 31 and 32, wherein rotation of the dispenser shaft in dispensing and orientation of the shaft slot 30 over the second ramp 21 positions the first and second flanges 31 and 32 in an abutting relationship with the remaining pencil members 36 within the hopper 37.

The housing floor 17 includes (see FIGS. 5–8) a plurality of mounting bosses 52, each including a plurality of ferrous metallic lugs 53 extending from the mounting boss orthogonally oriented relative to the housing floor 17. A rigid mounting plate 145 (see FIG. 6) having an adhesive layer 146 includes a peel-away flexible web 147 arranged for removal relative to the adhesive layer 146 to prevent exposure of the adhesive layer for its adherence to an underlying support surface (not shown). A plurality of support boss members 48 are fixedly mounted to a top surface of the mounting plate 145, wherein the boss members each include a plurality of boss member bores 49, having a magnetic interior wall 50. At least one or a plurality of the boss bores 49 includes an adhesive filled capsule 51 contained therewithin for enhanced securement of the lugs 53 within the associated boss bores 49 to provide for permanent securement of the mounting bosses 52 to the support boss members 48.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A writing instrument dispenser apparatus, comprising, a base housing, having a housing front wall spaced from a housing rear wall, a housing first side wall spaced from and parallel to a housing second side wall, and the housing second side wall is of an L-shaped configuration, and wherein the base housing includes a top wall, wherein the second side wall extends above the top wall, and the housing including a housing floor, wherein the first side wall is oriented between the housing floor and the housing top wall, the housing front wall having a front wall opening, with the front wall opening including a lowermost edge, and a first ramp extending from the lowermost edge towards the housing floor, and a second ramp extending from the first ramp towards the top wall, wherein the first ramp and the second ramp are defined at an obtuse angle therebetween, and hopper means extending from the top wall for depositing of individual writing instrument members onto the second ramp, and the first ramp is arranged to include a first length, and the second ramp having a second length, wherein the first length is less than said second length, and an intermediate wall positioned between the first side wall and the second side wall, and the intermediate wall is coextensive and parallel relative to the second side wall, with the second side wall having a second side wall extension flange, and the intermediate wall having an intermediate wall extension flange, with a first opening directed through the second side wall in adjacency to the second side wall extension flange, and a second opening coaxially aligned with the first opening oriented through the intermediate wall adjacent the intermediate wall extension flange, and a dispensing shaft, having a dispensing shaft first end rotatably directed through the first opening and a dispensing shaft second end directed rotatably through the second opening, with the dispensing shaft first end including a handle oriented exteriorly of the second side wall, and a shaft slot directed into the dispensing shaft orthogonally oriented between the intermediate wall and the second side wall in adjacency to the hopper means, and the hopper means includes the second side wall extension flange and the intermediate wall extension flange, and further including a rear wall extension flange extending from the rear wall, and the hopper having a hopper front wall, the hopper further including a hopper floor, wherein the hopper floor is canted from the rear wall extension flange towards the housing floor, with the hopper floor having a hopper floor forward edge spaced from and parallel to the rear wall extension flange, and the hopper floor forward edge oriented below the hopper front wall and oriented above the second ramp, and the dispensing shaft includes first and second arcuate flanges that are arranged in a parallel coextensive relationship relative to one another and extend radially and project exteriorly of the dispensing shaft, with the hopper floor forward edge including first and second slots that are arranged in a parallel relationship to receive the respective first and second arcuate flanges respectively therethrough.

2. An apparatus as set forth in claim 1 wherein the housing floor includes a plurality of mounting bosses, with each mounting boss including a plurality of ferrous metallic lugs extending orthogonally relative to the housing floor, and a mounting plate, the mounting plate including an adhesive layer, and a peel-away flexible web extending over the adhesive layer permitting selective exposure of the adhesive layer, with the mounting plate including a plurality of support boss members, with each support boss member including a plurality of boss bores, wherein each of the boss bores are arranged to receive the lugs of one of said mounting bosses.

3. An apparatus as set forth in claim 2, wherein each of the support boss bores includes a magnetic wall therewithin for magnetic adherence to the lugs.

4. An apparatus as set forth in claim 3 wherein at least one of said boss bores includes an adhesive capsule contained therewithin arranged for adhesive securement of the lugs within said at least one boss bore.

* * * * *